US005959941A

United States Patent [19]

Murakami et al.

[11] Patent Number: 5,959,941

[45] **Date of Patent: *Sep. 28, 1999**

[54] ELECTRONIC WATCH

[75] Inventors: Akiyoshi Murakami, Tokorozawa; Kenji Shimoda, Hoya; Michiko Yagi, Iruma; Kenji Fujita, Sayama, all of Japan

[73] Assignee: Citizen Watch Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/671,630

[22] Filed: Jun. 28, 1996

[30] Foreign Application Priority Data

Jun. 30, 1995 [JP] Japan ..... 7-164925

[51] Int. Cl.[6] ..... G04B 19/04; G04F 8/00

[52] U.S. Cl. ..... 368/80; 368/110

[58] Field of Search ..... 368/72–74, 80, 368/110–113, 157, 160

[56] References Cited

U.S. PATENT DOCUMENTS

| | | | |
|---|---|---|---|
| 4,259,737 | 3/1981 | Berney | 368/66 |
| 4,387,437 | 6/1983 | Lowrey et al. | 368/244 |
| 4,398,832 | 8/1983 | Maire et al. . | |
| 4,419,019 | 12/1983 | Nishimura et al. | 368/74 |
| 4,459,031 | 7/1984 | Perucchi | 368/9 |
| 4,470,707 | 9/1984 | Chambon et al. | 368/74 |
| 4,493,559 | 1/1985 | Ishida et al. | 368/74 |
| 4,545,686 | 10/1985 | Ushikoshi | 368/63 |
| 4,657,405 | 4/1987 | Nakazawa | 368/110 |
| 5,151,885 | 9/1992 | Kasuo | 368/110 |
| 5,166,912 | 11/1992 | Kanesaka | 368/110 |

FOREIGN PATENT DOCUMENTS

| | | |
|---|---|---|
| 3630900A1 | 6/1996 | Germany . |
| 55-89787 | 7/1980 | Japan . |
| 58-27085 | 2/1982 | Japan . |

*Primary Examiner*—Vit Miska

*Attorney, Agent, or Firm*—Dickstein Shapiro Morin & Oshinsky, LLP

[57] ABSTRACT

An electronic watch with a chronograph function comprises a motor, a current time counter, a hand position counter, a coincidence detector and a backward/forward movement determining unit. When a chronograph mode is selected, a second hand moves backward or forward to a 12-o'clock (zero) position depending upon its position in a time measurement and indication mode. The electronic watch reliably resumes the time measurement and indication after it functions as a chronograph.

8 Claims, 9 Drawing Sheets

ELECTRONIC WATCH

BACKGROUND OF THE INVENTION

1. Field of the Invention

This invention relates to an electronic watch which is driven by one motor and has a chronograph function.

2. Description of the Prior Art

Analog watches with various optional functions, such as a chronograph, a timer and an alarm, have been developed and are available at present. A number of patent applications have been filed for such analog watches. For instance, Japanese Patent Laid-Open Publication No. Hei 58-027085 discloses an electronic watch which has the chronograph function, and offers ordinary time measurement and indication, and selectively performs elapsed time recording.

Further, Japanese Patent Laid-Open Publication No. Sho 55-089787 describes an analog alarm watch in which an hour hand and a minute hand are used to indicate a time set in advance as well as to perform the time measurement and indication.

However, such electronic watches with various functions are prone to problems that the hands have to be moved extensively when changing operation modes, and that a number of stepping motors have to be used so as to accelerate the operation mode change. Thus, they inevitably become large and expensive.

This invention is intended to overcome the foregoing problems of the prior art, and to provide an electronic watch which can operate with one motor and also function as a chronograph.

SUMMARY OF THE INVENTION

In order to accomplish the foregoing objects, in a first aspect of the invention, there is provided an electronic watch with a chronograph function as well as a time measuring and indicating function, comprising: (a) pulse generating means for generating at least a time indicating pulse and a fast movement pulse in response to a pulse signal from an oscillator; (b) command input means for entering a chronograph function start command and a chronograph stop command; (c) first hand moving means for quickly moving a hand indicating a current time to a chronograph start position in accordance with the fast movement pulse when the chronograph start command is inputted; (d) time recording means for recording an elapsed time and advancing the hand from the chronograph start position; and (e) second hand moving means for quickly returning the hand, which is being advanced by the time recording means, by an extent corresponding to the extent quickly moved to the chronograph start position, to the current time position in accordance with the time indicating pulse when the chronograph stop command is inputted.

According to this arrangement, the hand is usually operated by the time indicating pulse generated by the pulse generating means. When the chronograph function start command is entered by the command input means, the chronograph function mode is established. First of all, the hand is moved quickly to the chronograph start position by a fast movement pulse. Then, timing recording is started, and the hand is advanced in response to a time recording pulse. When the chronograph function stop command is entered by the command input means, the time recording function is interrupted, so that the hand is quickly moved to the current time position by the extent, which is moved to the chronograph start position, in response to the fast movement pulse. Then, the hand resumes indicating the current time.

The electronic watch may further comprise: (f) current time measuring means for measuring an expected position of the hand associated with the current time and storing the measured expected position, and (g) coincidence detecting means for making the current position of the hand coincide with the position measured by the current time measuring means.

The hand is returned to the correct current time by the second hand moving means using the fast movement pulse based on the current time measured by the current time measuring means and the coincidence detected by the coincidence detecting means.

The electronic watch may further comprise control timer means which is activated in response to the chronograph stop command from the command input means and suspends the movement of the hand for a predetermined length of time.

This arrangement facilitates the reading of an elapsed time since the hand remains stationary for a predetermined length of time.

The electronic watch may further comprise: (h) first hand movement direction determining means for determining a direction in which the hand is moved to the chronograph start position depending upon a current position of the hand and notifying the hand moving direction to the first hand moving means; and (i) second hand movement direction determining means for determining a direction in which the hand is moved to the current time position in accordance with the hand movement direction determined by the first hand movement direction determining means and notifying the second hand returning means of the determined direction.

The first hand movement direction determining means checks the current position of the hand when moving the hand to the chronograph start position, and notifies the first hand moving means of the direction to move the hand to the chronograph start position.

In the electronic watch, the hand is a second hand.

In response to the chronograph function start command from the command input means, the first hand moving means moves the second hand to the chronograph start position. Time recording is started by the time recording means in response to the time recording pulse. Simultaneously, the second hand advances from the chronograph start position. When the chronograph stop command is issued, the second hand moving means returns the second hand to the current time position by the extent to which the second hand was moved to the chronograph start position.

The electronic watch may further comprise: (j) a display which is activated in response to the chronograph start command inputted by the command input means and indicates that the chronograph function is being performed.

The display indicates that the chronograph function is being performed, which enables the user to easily recognize whether the electronic watch shows the current time or an elapsed time.

These and other objects, features and benefits of the invention will be better understood from consideration of the following detailed description taken in conjunction with the accompanying drawings.

DESCRIPTION OF THE PREFERRED EMBODIMENT

Operation of an electronic watch according to the invention will be described with reference to FIGS. 1(*a*) to FIGS. 3(*d*).

In the electronic watch, a second hand 101 indicates a current second, or a chronograph second for the time recording mode, and hour and minute hands 102 indicate the current time. An external switch (called the "chronograph switch") 103 is a command input member, and is operated to change the time measurement and indication mode over to the chronograph mode, and to start and stop the chronograph mode. A winding stem 104 mechanically moves the hour and minute hands 102.

Figure 1:
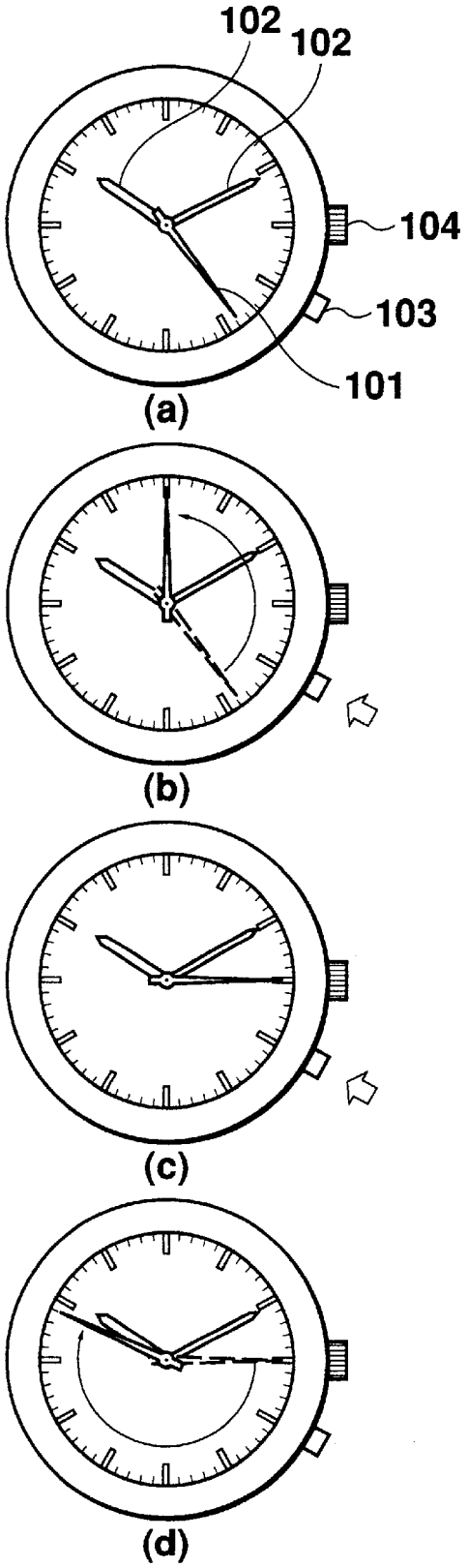
FIGS. 1(*a*) to 1(*d*) show the operation principle in a first example of an electronic watch according to an embodiment of the invention.

FIGS. 1(*a*) to 1(*d*) show a state in which the electronic watch indicates 10:10'24" (i.e. ten ten and 24 seconds), and the chronograph function is executed for 15 seconds.

When the chronograph switch 103 is operated once on the electronic watch which is in the time measurement and indication mode as shown in FIG. 1(*a*), a chronograph start function start command is issued. Then, the second hand 101 is quickly moved back to the 12 o'clock position (i.e. the chronograph start position) by first hand moving means (to be described later). Since the electronic watch has only one motor, the hour and minute hands 102 indicate 10:10 which is 24 seconds behind. The second hand 101 also functions as a chronograph second hand, and starts and performs the time recording second by second. In other words, the second hand 101 indicates an elapsed time on the electronic watch which is 24 seconds behind.

Then, the chronograph switch 103 is operated again, so that a chronograph function stop command is issued, which makes the second hand 101 stop at a 15-second position in accordance with the elapsed time, as shown in FIG. 1(*c*). A control timer (to be described later) is activated in response to the chronograph function stop command. The second hand 101 remains stationary for ten seconds. When a time period set by the control timer expires, the chronograph mode will be released. Second hand moving means advances the second hand 101 so as to catch up with a 34-second delay and enable the electronic watch to indicate 10:10'49", i.e. the current time. The foregoing adjustment is performed because the electronic watch continues the time measurement and indication while the chronograph mode is effective for 15 seconds, and the chronograph stop mode is on 10 seconds after 10:10'24".

Further, when the external switch 103 is operated in the state shown in FIG. 1(*c*), the electronic watch is forced to return to the time measurement and indication mode. In this case, the time indication is also corrected in accordance with the right time.

Figure 2:
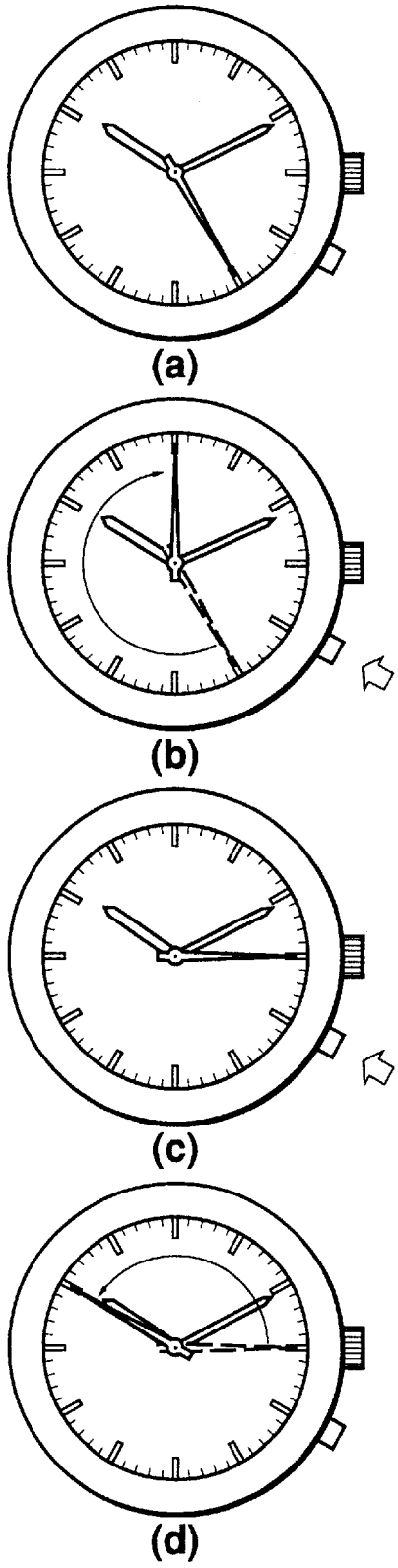
FIGS. 2(*a*) to 2(*d*) are views similar to FIGS. 1(*a*) to 1(*d*) showing a second example.

FIGS. 2(*a*) to 2(*d*) show how the electronic watch functions when the chronograph mode is selected at 10:10'25". The operation of the external switch 103 establishes the chronograph mode, so that the second hand 101 quickly advances to the chronograph start position, as shown in FIG. 2(*b*). Then, the second hand 101 starts the chronograph function. In other words, the electronic watch performs the time recording as the chronograph while the hour and minute hands 102 indicate the current time which is 35 seconds ahead. When the external switch 103 is operated in this state, the second hand 101 stops at the 15-second position which corresponds to the elapsed time. The second hand 101 remains there for ten seconds, so that the electronic watch shows the current time which is 25 seconds ahead. This is because the chronograph function is started in a state where the time indication is 35 seconds ahead, and then it remains stationary for 10 seconds. Therefore, the second hand 101 is moved backwards so as to compensate for a 25-second gain and resume the current time indication.

Figure 3:
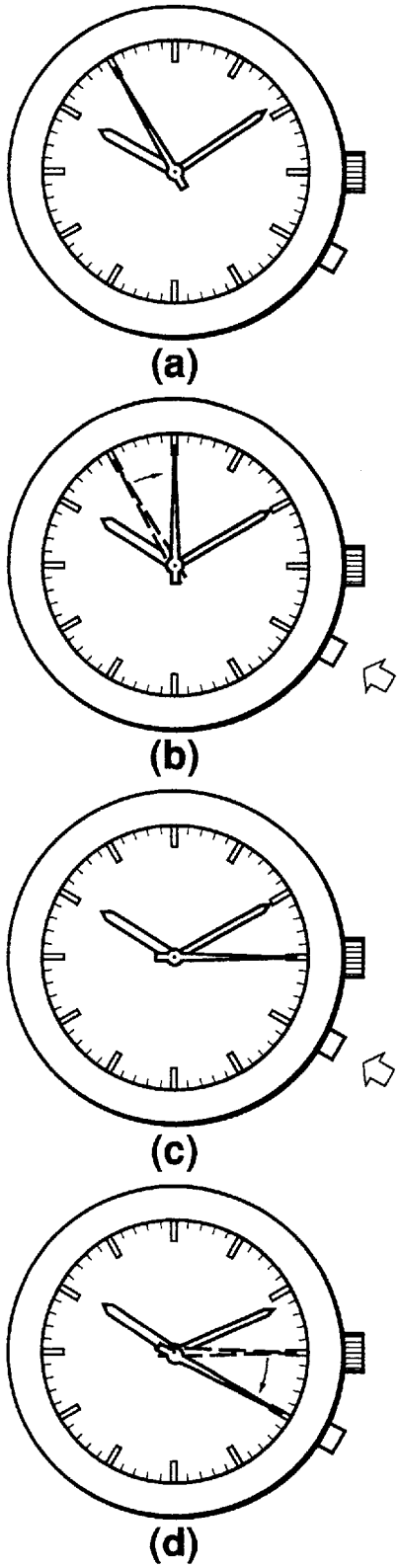
FIGS. 3(*a*) to 3(*d*) are views similar to FIGS. 1(*a*) to 1(*d*) showing a third example.

Assume that the current time is 10:10'55" as shown in FIG. 3(*a*). When the external switch 103 is operated in this state, the second hand 101 advances to the chronograph start position, and starts the chronograph function. The time recording is initiated while the electronic watch indicates the time which is 5 second ahead. The operation of the external switch 103 in this state makes the second hand 101 stop at the 15-second position in accordance with the elapsed time, as shown in FIG. 3(*c*). The second hand 101 remains stationary for 10 seconds set by the control timer, so that the electronic watch resumes its ordinary time measurement and indication which is 5 seconds behind. This is because at first the time indication is 5 second ahead, but the second hand 101 remains stationary for 10 seconds. This means that the time indication is 5 seconds behind overall. Therefore, the second hand 101 is moved forward so as to catch up with a 5-second delay. Thus, the electronic watch indicates the correct current time.

Figure 4:
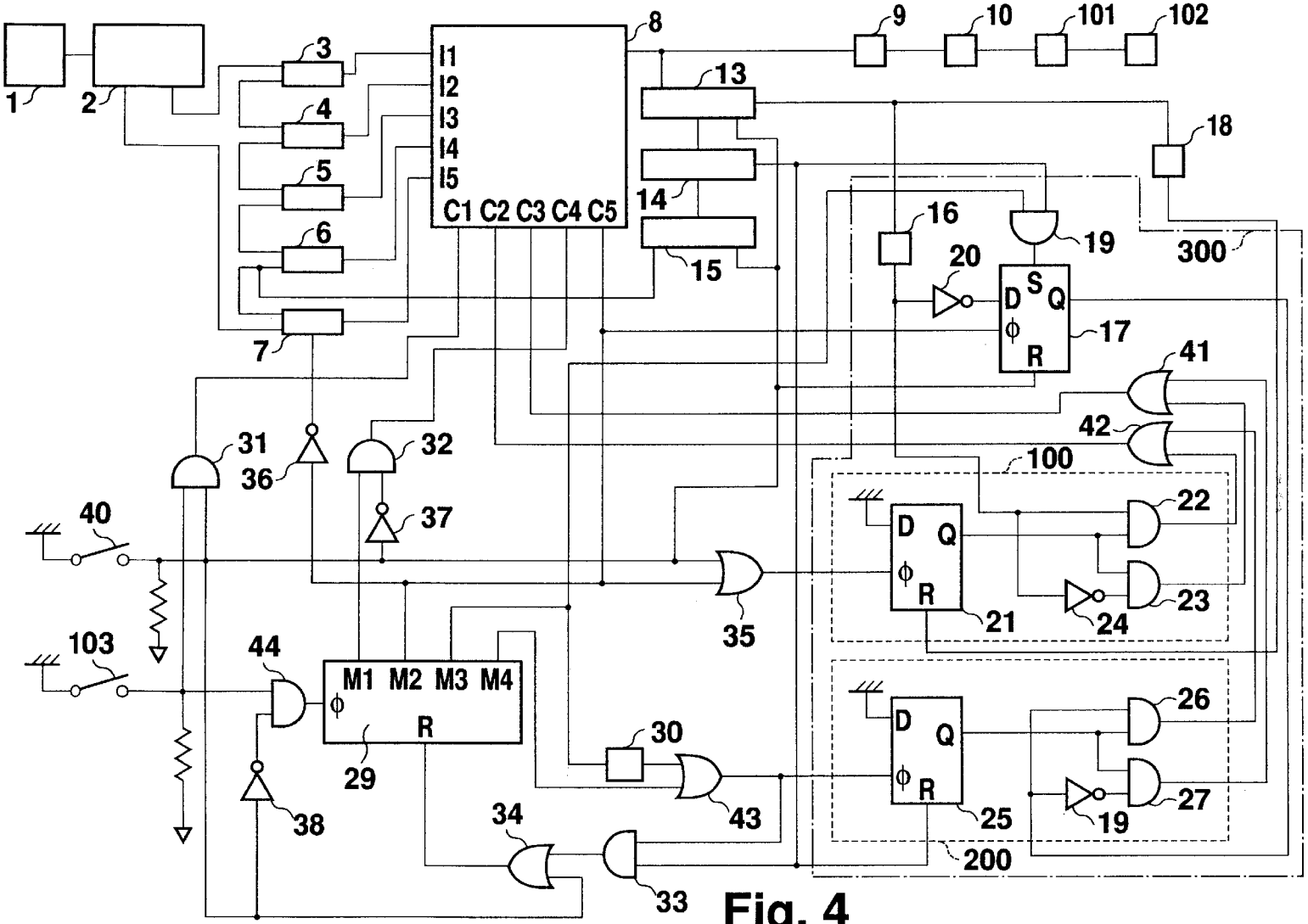
FIG. 4 is a block diagram showing the configuration of the electronic watch.

A system for operating the electronic watch will be described with reference to the block diagram shown in FIG. 4. The system comprises an oscillator 1, a divider 2, a chronograph start position return signal waveform shaping circuit 3, a pulse generating section (including a fast forward signal generator 4, a fast backward signal generator 5, an ordinary second signal generator 6, a chronograph second signal generator 7), a pulse selector group 8, a motor driver 9, a motor 10, a hand position counter 13, a coincidence detecting circuit 14, a current time counter 15, a section checking circuit 16, a section memory 17 (a data flip-flop 17, called "D.F.F. 17"), AND gates 17 and 19, a forward/backward movement checking unit 300, a chronograph switch 103, a shift register 29, a timer circuit 30, a zero-position detector 18, a reset switch 40, AND gates 31–33, OR gates 34 and 35, and inverters 36–38.

The oscillator 1 oscillates a reference signal.

The divider 2 divides the oscillated reference signal.

The first hand moving signal waveform shaping circuit 3 generates a signal for moving the second hand 101 to the chronograph start position.

The fast forward signal generator 4 generates a signal for the fast forward movement of the second hand 101.

The fast backward signal generator 5 generates a motor drive signal for the fast backward movement of the second hand 101.

The ordinary second signal generator 6 generates a signal for the second-by-second movement of the second hand 101 in the time measurement and indication mode.

The chronograph second signal generator 7 generates a signal for the second-by-second movement of the second hand 101 in the chronograph mode.

The pulse selector group 8 selects one of the foregoing signals, and includes input terminals I1 to I5 and input terminals C1 to C5, and selectors 81 to 84. In the pulse selector group 8, when the input terminal C1 receives a high (H) level signal, a signal from the input terminal I1 is selected, and when the input terminal C2 receives an H-level signal, a signal from the input terminal I2 is selected. Further, if signals at some of the input terminals C1 to C5 have the H level at the same time, lower-numbered input terminals will be selected out of the terminals I1 to I5, with preference. The selector group 8 will be described in detail later.

The motor driver 9 is connected to an output end of the selector group 8, and actuates the motor 10 in response to the signal selected by the selector group 8. The motor 10 actuates the second hand 101, which causes hour and minute hands 102 to move in an interlocked manner.

The hand position counter 13 sexagesimally counts stepping motions of the motor 10.

The current time counter (current time measuring means) 15 sexagesimally counts signals outputted from the ordinary second signal shaping circuit 6.

The coincidence checking circuit (coincidence detecting means) 14 checks whether or not the counts (i.e. the hand position) of the hand position counter 13 and the current time counter 15 are in agreement with each other.

The section checking circuit 16 detects a current position of the second hand 101, and is configured so as to provide a low (L) level signal when the second hand 101 is anywhere between 1-second and 24-second positions, while a high (H) level signal is outputted when the second hand 101 is anywhere between 25-second and 59-second positions.

The section memory 17 stores the signal outputted by the section checking circuit 16, and includes a data flip-flop (called the "D.F.P. 17"), to which an inverter 20 and an AND gate 19 are connected.

The forward/backward movement checking unit 300 is constituted by a first hand movement direction determining member 100 including AND gates 22, 23 and an inverter 24 which are connected to a D.F.F. 21, and a second hand movement direction determining member 200 including AND gates 26, 27 and an inverter 28 which are connected to a D.F.F. 25.

The first hand movement direction determining member 100 or the second hand movement direction determining member 200 is connected to the selector group 8 via OR gates 41 and 42.

The chronograph switch 103 is operated so as to selectively execute a time recording function, i.e. a chronograph function, and to resume the time measurement and indication.

The shift register 29 generates control signals. In the shift register 29, an output terminal M1 receives a signal having an H level (called "H-level signal") once a reset mode is established. Thereafter, each time a clock signal is inputted to a terminal Φ, output terminals M2 and M3 receive H-level signals sequentially.

The timer circuit (control timer means) 30 is released from the reset state, and counts 10 seconds when the output terminal M3 receives the H-level signal in the shift register 29. After a lapse of 10 seconds, the timer circuit 30 provides an H-level signal to the OR gate 43.

The chronograph start position detecting circuit 18 detects whether or not the second hand 101 is at the chronograph start position.

The reset switch 40 cooperates with the winding stem 104 so as to reset the circuits other than the oscillator 1 and the divider 2, as will be described later.

The operation of the electronic watch will be described with reference to FIGS. 4 to 7.

It is necessary to return the second hand 101 to the chronograph start position so as to start the chronograph mode.

Similarly to an ordinary watch, the winding stem 104 is pulled and turned so as to move the hour and minute hands 102 and set the time on the electronic watch.

While the winding step 104 remains pulled, the reset switch 40 is activated to establish the reset mode, thereby resetting the hand position counter 13, the current time counter 15, D.F.F. 17, and the shift register 29. When the chronograph switch 103 is operated in this state, an output signal at the AND gate 31 has the H level. Then, a signal inputted in the input terminal C1 of the selector group 8 has the H level. Thus, the output signal of the first hand moving signal waveform shaping circuit 3 will be selected, thereby activating the motor driver 9 and the motor 10. Then, the second hand 101 will be moved.

When the second hand 101 reaches the chronograph start position, the chronograph switch 103 will be released.

The winding stem 104 is returned to its original state, and the reset switch 40 is turned off, which causes the second hand 101 to stay at the chronograph start position. The H-level output signal from the output terminal M1 in the shift register 29 is inputted to the input terminal C4 of the selector group 8, thereby returning the electronic clock to the time measurement and indication mode.

In the time measurement and indication mode, the input terminal C4 receives the H-level signal, so that the input terminal I4 selected, and a signal will be outputted from the ordinary second signal waveform shaping circuit 6. Therefore, the second hand 101 starts moving second by second as usual. The current time counter 15 measures the number of signals outputted by the ordinary second signal waveform shaping circuit 6, and the hand position counter 13 counts the stepping motions of the second hand 101.

The chronograph function of the electronic switch is described hereinafter.

Figure 5:
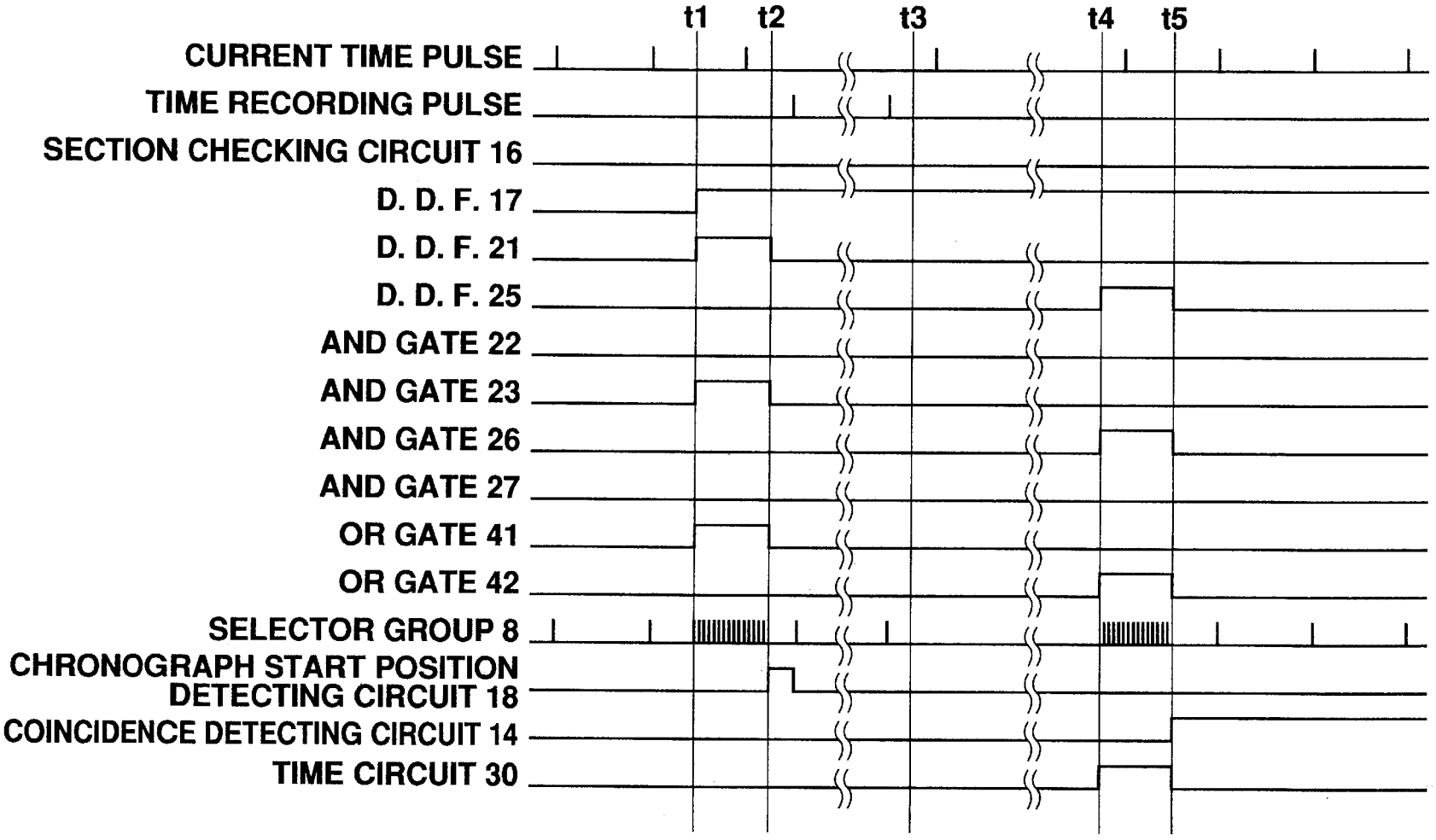
FIG. 5 is a timing chart showing the operation sequence of the electronic watch shown in FIGS. 1(*a*) to 1(*d*)

It is assumed here that the second hand 101 is anywhere between the 0-second and 24-second positions (shown in FIG. 2(*a*)). Referring to FIG. 5, when the chronograph switch 103 is operated in the time measurement and indication mode, one clock signal is outputted to the AND gate 44. In this state, another input signal present at the AND gate 44 has the H level, so that the clock signal is inputted in the terminal Φ of the shift register 29. A signal from the output terminal M2 has the H level, thereby establishing the chronograph mode. In this mode, resetting of the chronograph second signal waveform shaping circuit 7 will be released. Concurrently, the H-level signal is inputted to the OR gate 35 from the output terminal M2 (of the shift register 29).

Another input signal at the OR gate 35 has the L level, so that the output signal of the OR gate 35 changes to the H level from the L level. In synchronization with the rise of this output signal, the D.F.F. 21 reads an H-level signal inputted in the input terminal D, and outputs an H-level signal (at time t1 shown in FIG. 5). Further, since the second hand 101 is anywhere between the 0- and 24-second positions when the chronograph switch 103 is operated, the section checking circuit 16 outputs an L-level signal. The D.F.F. 17 reads the L-level signal via the inverter 20 in synchronization with the rise of the signal from the output terminal M2.

The D.F.F. 25 remains as it is after the reset in the initial stage, and outputs an L-level signal. Therefore, both the AND gates 26 and 27 output L-level signals. The output signal of the D.F.F. 21 changes to the H level, and the inverter 24 outputs an H-level signal obtained by reversing the output signal of the section checking circuit 16. Due to these H-level signals, the output signal at the AND gate 23 changes to the H level. Thus, when a signal from the input terminal C3 has the H level, the selector group 8 selects a signal at the input terminal I3, and a signal is outputted from the fast backward signal waveform shaping circuit 5. Thereafter, the second hand 101 is quickly moved backward to the chronograph start position by the operation of the motor driver 9 and the motor 10.

The hand position counter 13 is counted down in accordance with the counted backward motions of the second hand 101. When the count of the hand position counter 13 becomes zero, the chronograph start position detector 18 detects zero, and outputs an H-level signal (at time t2 in FIG. 5). The, the D.F.F. 21 is reset, and an output signal at the terminal O has the L level. An output signal at the terminal O has the L level, and the AND gate 23 and the OR gate 41 have L-level output signals. The input terminal C5 has had the H-level signal at the time t1, so that the selector group 8 selects the output signal of the chronograph second signal waveform shaping circuit 7. Thus, the second hand 101 functions in the chronograph mode. The foregoing sequence is shown in FIGS. 2(*a*) to 2(*d*).

The fast backward pulse signal has a frequency for enabling the second hand 101 to be returned to the chronograph start position within one second at maximum. Therefore, the second hand 101 records a first chronograph second when the chronograph switch 103 is operated, i.e. one second after the time t1 shown in FIG. 5, which includes the time period for the second hand 101 to return to the chronograph start position.

When the chronograph switch 103 is operated in the chronograph mode, a clock signal is inputted in the shift register 29 via the AND gate 44, and an output signal at the output terminal M3 changes to the H level. This establishes the chronograph stop mode (at time t3 shown in FIG. 5). In this mode, the timer circuit 30 is released from the reset state, and starts counting ten seconds. In this state, all the input terminals C1 to C5 of the selector group 8 have the H-level signals, which prevents the operation of the second hand 101. The second hand 101 remains stationary for ten seconds, showing the elapsed time. After counting ten seconds, the timer circuit 30 outputs an H-level signal (at time t4 shown in FIG. 5).

Further, when the chronograph switch 103 is operated within ten seconds of the chronograph stop mode being established, a signal at the output terminal M4 of the shift register 29 has the H level. In any case, the output signal at the OR gate 43 changes to the H level from the L level. In synchronization with the rise of the output signal of the OR gate 43, the D.F.F. 25 reads the H-level signal at the input terminal D, and outputs an H-level signal.

In response to the H-level output signal of the D.F.F. 25 and an H-level output signal of the D.F.F. 17, the AND gate 26 receives an H-level signal. The signal at the input terminal C2 of the selector group 8 changes to the H level. Thus, the selector group 8 selects the input terminal I2, and a signal is outputted from the fast forward signal waveform shaping circuit 4, thereby actuating the motor driver 9 and the motor 10, which cause the second hand 101 to quickly advance to the chronograph start position. At the same time, the hand position counter 13 counts up the fast forward motions of the second hand 101. When the count of the hand position counter 13 agrees with the count of the current time counter 15, the coincidence detector 14 detects the coincidence, and outputs an H-level signal, thereby resetting the D.F.F. 25. Then, this H-level output signal changes to the L level, and the outputs signals at the AND gate 26 and the OR gate 42 also change to the L level. The H-level output signal from the coincidence detector 14 and the H-level output signal from the AND gate 33 cause the output signal from the AND gate 33 to change to the H level. The shift register 29 is reset via the OR gate 34. The output signal from the output terminal M1 changes to the H level. Thus, the electronic watch returns to the time measurement and indication mode. Then, the timer 30 is reset, and has its output signal changing to the L level (at time t5 shown in FIG. 5). in the time measurement and indication mode, the AND gate 33 outputs the H-level signal. The selector group 8 selects the output signal of the ordinary second signal waveform shaping circuit 5, enabling the second hand 101 to perform the second-by-second time measurement and indication. Since the current time counter 15 continues the time measurement even during the chronograph mode, the electronic watch can resume its correct time indication on the basis of the coincidence detected by the current time counter 15 and the hand position counter 13.

The chronograph function is performed as follows when the second hand 101 is anywhere between 25-second and 49-second positions (shown in FIGS. 2(*a*) to 2(*d*)) with reference to FIG. 6.

This function is basically identical to that described with respect to the second hand 101 staying anywhere between 0-second and 24-second positions, but differs from the foregoing example in the following respects. In this case, when the chronograph mode is selected, an output signal of the section checking circuit 16 has the H level, so that an output signal of the AND gate 22 has the H level. An output signal at the input terminal C2 of the selector group 8 has the H level. Thus, the second hand 101 is fast forwarded to the chronograph start position.

The hand position counter 13 counts up fast forward motions of the second hand 101. When the count of the hand position counter 13 becomes zero, the chronograph start position detecting circuit 18 detects "0", and outputs an H-level signal. Thus, the D.F.F. 21 is reset, the output signal at the terminal Q changes to the L level. The output signals of the AND gate 22 and the OR gates 42 also change to the L level. The output signal at the input terminal C5 has H level, the selector group 8 selects an output signal of the chronograph second signal waveform shaping circuit 7, which enables the second hand 101 to perform the second-by-second chronograph function, i.e. operates in the chronograph run mode (at times t1 and t2 shown in FIG. 6).

Figure 6:
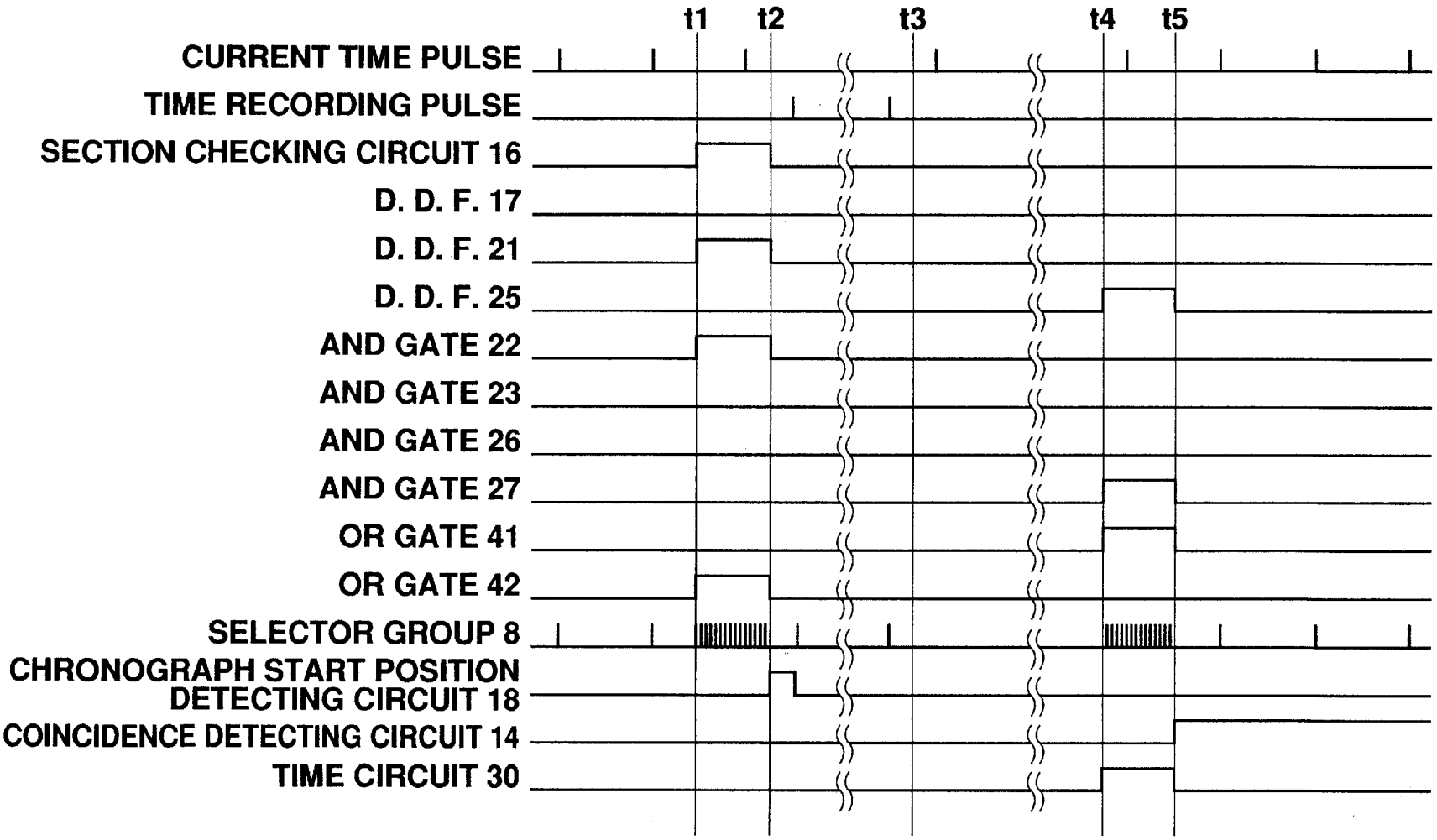
FIG. 6 is a timing chart showing the operation sequence of the electronic watch in FIGS. 2(*a*) to 2(*d*)

The operation of the chronograph switch 103 establishes the chronograph stop mode (at time t3 shown in FIG. 6). When the timer circuit 30 counts ten seconds or when the chronograph switch 103 is re-operated during the ten seconds, the electronic watch resumes its time measurement and indication as described above. However, since the output signal of the section checking circuit 16 had the H level at the start of the chronograph mode, the output signal of the D.F.F. 17 has the L level. Contrary to the chronograph function with the second hand being between the 0-second and 24-second positions, the output signal of the AND gate 27 has the H level. Thus, the input terminal C3 of the selector group 8 has an H-level signal via the OR gate 41. The selector group 8 selects the output signal of the fast backward signal waveform shaping circuit 4, actuating the motor driver 9 and the motor 10, and quickly returning the second hand 101 to the chronograph start position. At the same time, the hand position counter 13 counts down the fast backward motions of the second hand 101. When the counts of the hand position counter 13 and the current position counter 15 are in agreement, the coincidence detecting circuit 14 detects the coincidence, so that the electronic watch resumes its time measurement and indication (at times t4 and t5 shown in FIG. 6). FIG. 1(*d*) shows this state.

A third example shown in FIGS. 3(*a*) to 3(*d*) will be described referring to FIG. 7.

In the third example, the second hand 101 is anywhere between the 50-second and 59-second positions. The operations from the start of the chronograph function in the time measurement and indication mode till the chronograph stop mode are identical to those performed when the second hand 103 is anywhere between the 25-second and 49-second positions, and will not be repeated here.

This example differs from the second example in the chronograph stop state. In the second example, it is possible that the current time agrees with the time indicated in the chronograph mode when the chronograph stop is executed. This is because there is only at most a 10-second difference therebetween.

Figure 7:
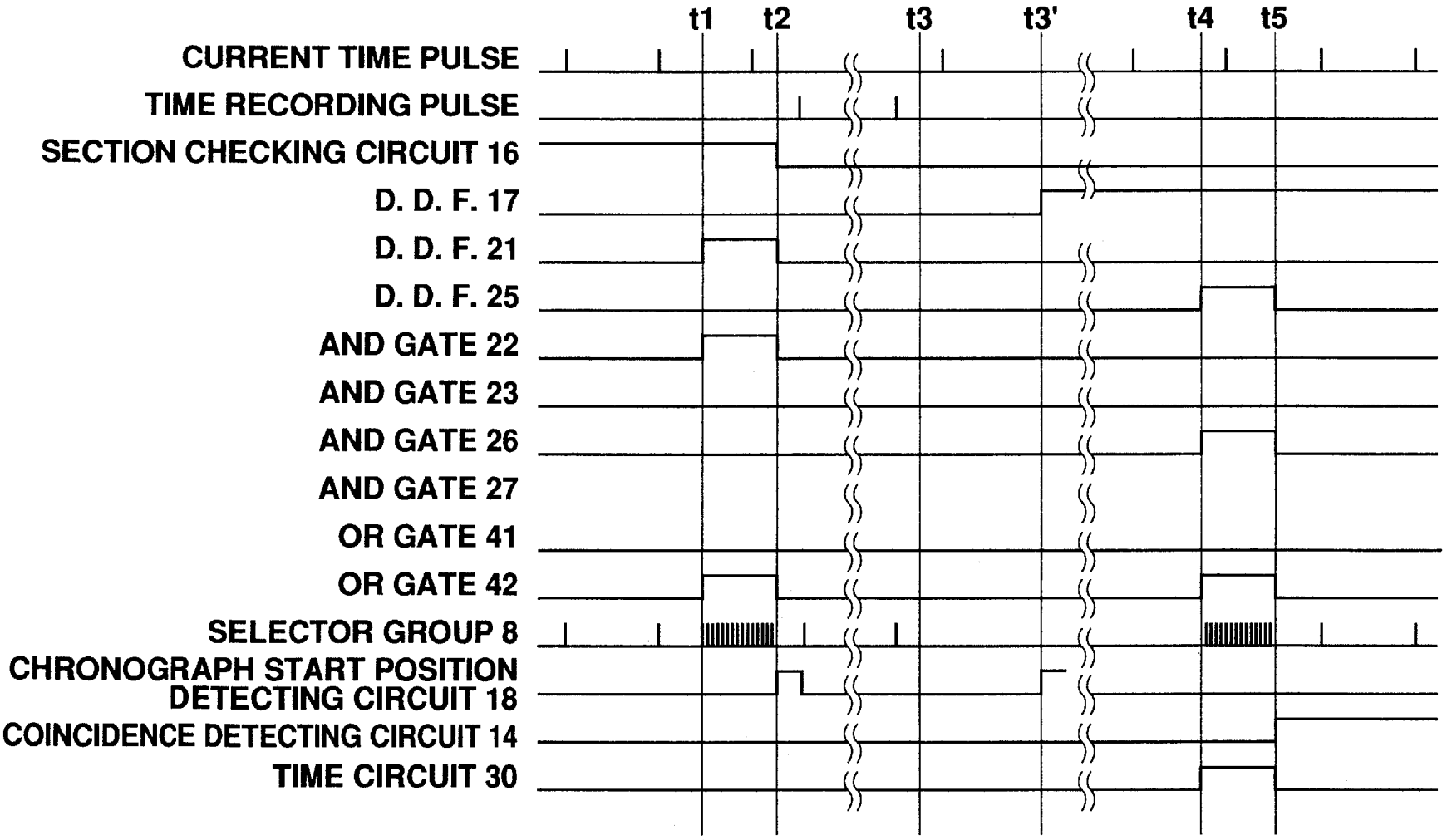
FIG. 7 is a timing chart showing the operation sequence of the electronic watch in FIGS. 3(*a*) to 3(*d*)

In the chronograph stop mode, the output signal of the D.F.F. 17 has the L level (at time t3 shown in FIG. 7). However, when the current time agrees with the chronograph time, i.e. when the counts of the hand position counter 13 and the current time counter 15 are equal, the coincidence detecting circuit 14 detects the coincidence, and emits an H-level output (at time t3' shown in FIG. 7). In this state, the shift register 29 outputs an H-level signal via the output terminal M3. Thus, an output signal at the AND gate 19 has the H level, so that the D.F.F. 17 is set, and outputs an H-level signal. Thereafter, the timer circuit 30 counts ten seconds, or the chronograph switch 103 is operated, so that the signal at the AND gate 26 changes to the H level. An output signal of the input terminal C2 of the selector group 8 changes to the H level via the OR gate 42. Thus, the second hand 101 advances so as to resume the current time indication (at times t4 and t5 shown in FIG. 7).

On the other hand, if the chronograph switch 103 is operated before the current time agrees with the chronograph time (i.e. before the counts of the hand position counter 13 and the current time counter 15 become equal), the output of the D.F.F. 17 remains at the L level. Thus, the output signal at the AND gate 27 changes to the H level, and the output signal of the input terminal C3 of the selector group 8 also changes to the H level, so that the second hand 101 moves backward to the current time indication.

In this example, the movement of the second hand 101 to return it to the ordinary time measurement and indication mode is controlled in accordance with the forward/backward direction in which the second hand 101 moved to the chronograph start position 101 when the time measurement and indication mode is changed over to the chronograph mode. The second hand 101 can be reliably returned to the time measurement and indication mode only through the detection of the coincidence between the hand position counter 13 and the current time counter 15 after the execution of the chronograph mode. Further, when the current time indication agrees with the chronograph time in the chronograph stop state, the electronic switch can reliably resume its ordinary time measurement and indication since the output signal of the D.F.F. 17 is reversed after the detection of the coincidence between the hand position counter 13 and the current time counter 15.

Figure 8:
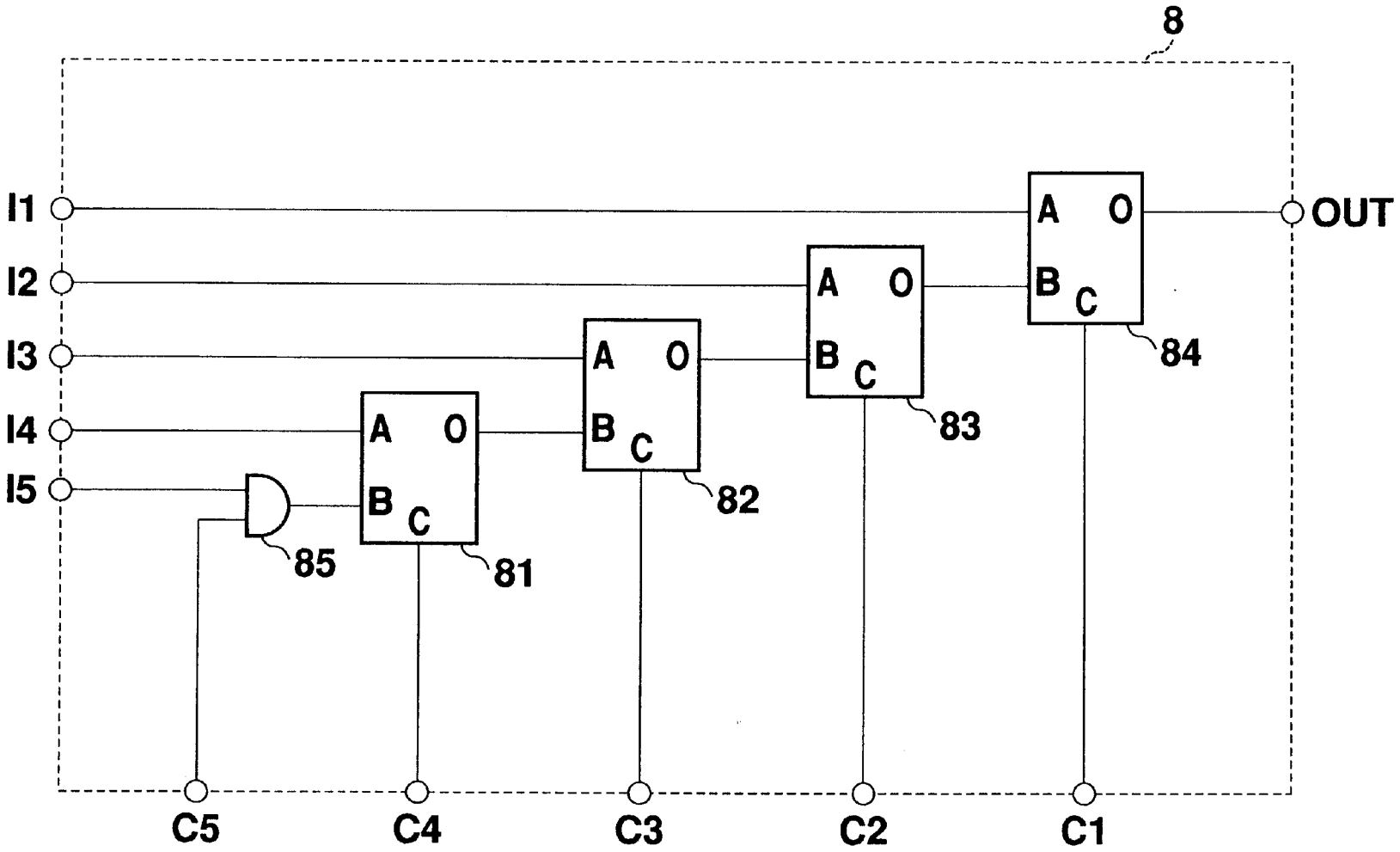
FIG. 8 is block diagram showing a selector group.

The selector group 8 will be described in detail with reference to FIG. 8. The selector group 8 includes selectors 81 to 84. Each of the selectors 81 to 84 has input terminals A, B and C, and an output terminal O. When the input terminal C receives an H level signal, a signal at the input terminal A is outputted via the terminal O. On the other hand, when the input terminal C receives an L level signal, an input signal at the input terminal B is outputted via the terminal O. Reference numeral 85 is an AND gate.

If the H-level signal is inputted only in the input terminal C1, the selector 84 outputs the signal which is inputted to the input terminal A from the input terminal I1. If the H-level signal is inputted only in the input terminal C4, the selector 81 outputs the signal, which is inputted in the input terminal I4 from the input terminal A, to the input terminal B of the selector 82. Since the signal at the input terminal C3 has the L level, the selector 82 outputs the signal, inputted in the input terminal B from the input terminal I4 via the selector 81, to the input terminal B of the selector 83. In the similar manner, the selector group 8 outputs the signal from the input terminal I4.

When both the terminals C2 and C5 receive the H level signals, the AND gate 85 outputs the signal to the input terminal B of the selector 81 from the input terminal I5, so that the signal from the input terminal I5 is outputted to the input terminal B of the selector 83. However, since the input terminal C2 has the H level signal, the selector 83 outputs the signal which is inputted in the input terminal A from the input terminal I2. Thus, the selector group 8 outputs the signal from the input terminal I2. The input terminal C2 is selected with preference when the input terminals C2 and C5 have the H level signals.

The selector group 8 is configured such that when a certain input terminal C has the H level signal, a signal from an input terminal I having the same identification number is used as a reference. For example, when only the input terminal C1 receives the H level signal, the signal from the input terminal I1 is outputted, and when only the input terminal C2 receives the H level, the signal from the input terminal I2 is outputted. Further, when a plurality of the input terminals C have the H level signals at the same time, a signal to an input terminal I corresponding to the input terminal C and having a smaller identification number will be preferentially selected.

If all the input terminals C receive the L level signals, the input terminal B of the selector 81 receives the L level signal, so that no signals will be outputted from the terminals I1–I5. Thus, an L-level signal will be outputted.

In order to change the time measurement and indication mode over to the chronograph mode, the second hand 101 is moved back to the chronograph start position when it is anywhere between 1-second and 24-second positions. On the other hand, the second hand 101 advances to the chronograph start position when it is anywhere between the 25-second and 59-second positions. The following describes the reason why the second hand 101 returns to the chronograph start position using two routes.

In the present invention, the second hand 101 also moves second by second in the chronograph mode. Thus, if the chronograph mode is executed accidentally, the user may recognize the time indication in the chronograph mode as being the ordinary time indication. Thus, it is preferable to minimize a difference between the chronograph time indication and the current time indication.

Assume that the electronic watch of the invention is configured as in the prior art, i.e. the second hand 101 is advanced to the chronograph start position when it is anywhere between the 31-second position and chronograph start position, and it is moved backward to the chronograph start position when it is anywhere between the chronograph start position and 30-second positions. In other word, the forward or backward movement of the second hand 101 is determined depending upon its position before or after the 30-second position. Thus, when the second hand 101 moves backward to the chronograph start position, the electronic watch shows the current time which is 30 seconds behind. Further, since the second hand 101 remains stationary for 10 seconds in the chronograph stop mode, the electronic watch shows the current time which is 40 second behind at maximum.

In the present invention, when the second hand 101 is between the 1-second and 24-second positions, it is moved backward to the chronograph start position. On the other hand, it advances to the chronograph start position when it is between 25-second and 59-second positions. In these cases, the current time indication is either 35 seconds behind or ahead at maximum. Thus, the backward or forward movement of the second hand 101 is determined depending upon whether the second hand 101 is in front of, at, or beyond the 25-second position.

As described above, the boundary between the backward movement and the forward movement correlates to a length of time during which the second hand 101 is kept stationary in the chronograph stop mode. In other words, in the foregoing embodiment, the second hand 101 remains stationary for 10 seconds in the chronograph stop mode, so that the backward or forward movement of the second hand 101 is determined depending upon whether the second hand is in front of, at, or beyond the 25-second position. This enables the deviation from the current time indication to be 35 seconds at maximum. If the second hand 101 remains stationary for 20 seconds in the chronograph stop mode, the backward or forward movement of the second hand 101 should be determined depending upon whether it is in front of, at, or beyond the 20-second position. In this case, the maximum deviation from the current time is 40 seconds.

Alternatively, the backward or forward movement of the second hand 101 may be determined at the 30-second position as in the prior art, regardless of the length of time during which the second hand 101 remains stationary in the chronograph stop mode. In such a case, the present invention can effectively accomplish its object to provide an electronic watch which is drivable by one motor and can resume the time measurement and indication mode after it functions as the chronograph.

Figure 9:
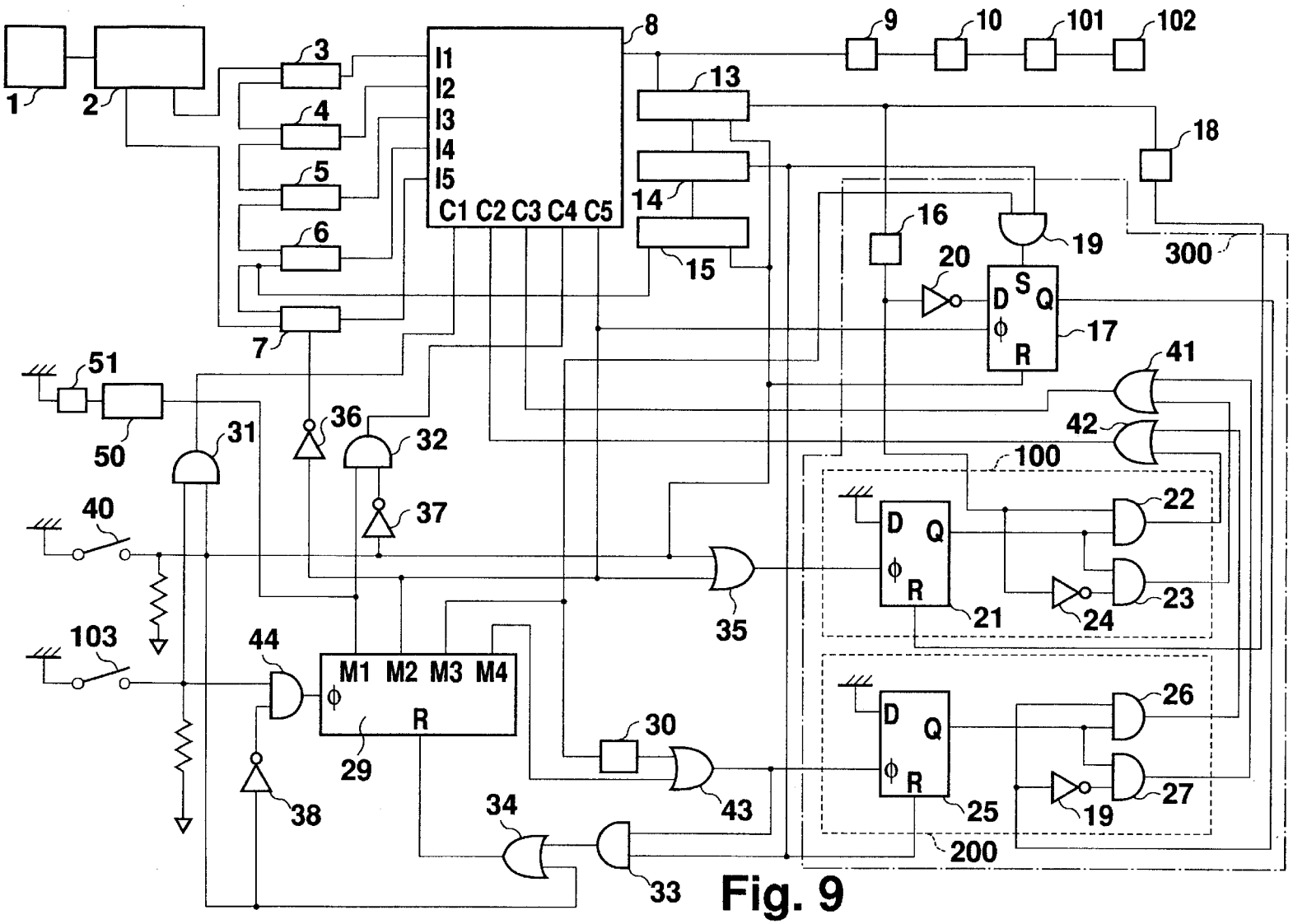
FIG. 9 is a block diagram of a circuit for a user to check whether the electronic watch is in a time measurement and indication mode or in a chronograph mode.

FIG. 9 is a block diagram showing the configuration of a circuit for indicating that the electronic watch is in the chronograph mode.

Referring to FIG. 9, in response to an output signal from the output terminal M1 of the shift register 29, an LED driver 50 causes an LED, a display, to be luminous. In the chronograph mode, the output terminal M1 receives an L-level signal, which is outputted to the LED driver 50. The LED indicates that the electronic watch is in the chronograph mode. This arrangement enables the user to recognize a current state of the electronic watch, i.e. the chronograph mode, thereby preventing the user from operating the electronic watch erroneously.

What is claimed is:

1. An electronic watch with a chronograph function as well as a time measuring and indicating function, comprising:

(a) pulse generating means for generating at least a time indicating pulse and a fast movement pulse in response to a pulse signal from an oscillator;

(b) command input means for entering a chronograph function start command and a chronograph stop command;

(c) first hand moving means for quickly moving a first number of degrees a hand indicating a current time to a chronograph start position in accordance with the fast movement pulse when the chronograph start command is inputted;

(d) time recording means for recording an elapsed time and advancing the hand from the chronograph start position; and (e) second hand moving means for quickly returning the hand, which is being advanced by the time recording means, to the current time position in accordance with the time indicating pulse when the chronograph stop command is inputted by moving said hand a second number of degrees that corresponds to said first number of degrees that said hand quickly moved to the chronograph start position.

2. The electronic watch according to claim 1, further comprising:

(f) current time measuring means for measuring an expected position of the hand associated with the current time and storing the measured expected position, and (g) coincidence detecting means for making the current position of the hand coincide with the position measured by the current time measuring means, wherein the hand is returned to the correct current time by the second hand moving means using the fast movement pulse based on the detection of the coincidence by the coincidence detecting means between the current position of the hand and the current time measured by the current time measuring means.

3. The electronic watch according to claim 2, further comprising control timer means which is activated in response to the chronograph stop command from the command input means and suspends the movement of the hand for a predetermined length of time.

4. The electronic watch according to claim 1, further comprising:

(h) first hand movement direction determining means for determining a direction in which the hand is moved to the chronograph start position depending upon a current position of the hand and notifying the hand moving direction to the first hand moving means; and (i) second hand movement direction determining means for determining a direction in which the hand is moved to the current time position in accordance with the hand movement direction determined by the first hand movement direction determining means and notifying the second hand moving means of the determined direction.

5. The electronic watch according to claim 1, wherein the hand is a second hand.

6. The electronic watch according to claim 1, further comprising: (j) a display which is activated in response to the chronograph start command inputted by the command input means and indicates that the chronograph function is being performed.

7. The electronic watch according to claim 1, wherein the second hand moving means is arranged to advance the hand through the 12 o'clock position on the watch.

8. The electronic watch according to claim 1, further comprising a control timer circuit which is activated in response to the chronograph stop command to suspend the movement of the hand for a predetermined length of time, and wherein the first hand moving means is arranged to move the hand in a direction based on the predetermined length on time.

* * * * *